US005419044A

United States Patent [19]

Valliere

[11] Patent Number: 5,419,044

[45] Date of Patent: May 30, 1995

[54] IV BAG CUTTER

[75] Inventor: Joseph B. M. Valliere, Hull, Canada

[73] Assignee: Ottawa General Hospital, Ottawa, Canada

[21] Appl. No.: 239,751

[22] Filed: May 9, 1994

[51] Int. Cl.[6] ..... B67B 7/00

[52] U.S. Cl. ..... 30/2; 30/294; 30/DIG. 3

[58] Field of Search ..... 30/2, 294, 280, DIG. 3

[56] References Cited

U.S. PATENT DOCUMENTS

| | | | |
|---|---|---|---|
| 2,254,199 | 9/1941 | Baltuch . | |
| 2,255,945 | 9/1941 | Shuler | 30/294 |
| 2,611,179 | 9/1952 | Butler | 30/294 |
| 2,748,478 | 6/1956 | Shelton . | |
| 2,881,520 | 4/1959 | Mito . | |
| 5,007,171 | 4/1991 | Horning, Jr. . | |

OTHER PUBLICATIONS

Sammons Catalogue p. 35.
North Coast Medical p. 96 1994.

*Primary Examiner*—Douglas D. Watts
*Attorney, Agent, or Firm*—David P. Gordon

[57] ABSTRACT

A cutter useful for opening relatively thin flat packages such as IV bags has a handle and a slot which receives the marginal edge of the package. A recessed blade within the slot severs the margin of the package, the slot being sufficiently narrow as to prevent either the contents of the package or the figures of the user from accidental contact with the blade.

10 Claims, 1 Drawing Sheet

IV BAG CUTTER

BACKGROUND OF THE INVENTION

1. Field of Invention

This invention relates to a new or improved cutting implement, and particularly to a manually engageable cutting implement that is useful for a variety of purposes.

2. Description of the Prior Art

Numerous examples of hand-held cutting implements are shown in the prior art, see for example U.S. Pat. No. 2,254,199 Baltuch which shows a cutting implement for twine; U.S. Pat. No. 2,748,478 Shelton which shows an envelope opener, and U.S. Pat. No. 5,007,171 which shows a bag opener.

There is a perceived need for an improved cutter or cutting implement that is safe and convenient in operation and that is particularly suitable for use by individuals whose vision, fine motor skills or muscular strength is impaired e.g. the elderly.

SUMMARY OF THE INVENTION

The invention provides a cutter useful for opening relatively thin and flat packages of flexible material, comprising a carrier that defines therein an elongate narrow channel having depth-limiting base means; a blade supported and shielded in the region of one end of the channel of said carrier and oriented to face in a forwards direction towards the second, opposite end of said channel at a predetermined spacing from the channel base means; said carrier defining a recess providing manual access to said channel laterally thereof at a location that is forward of said blade and between the blade and the channel base means; the arrangement being such that when a corner formed between two adjacent edges of a package is introduced into the channel in the direction of one said edge until the other package edge abuts the blade, the package corner can be grasped by the user to retain the package in proper alignment and supported so that the package material adjacent said one edge is tensioned to facilitate cutting thereof by the blade as the latter is moved relative to said package away from said corner along said one edge.

Preferably the carrier has an elongate handle to facilitate gripping and manipulation of the cutter by a user, the handle extending in the direction of the depth of the channel and sized to be engaged in the fingers and palm of one hand of the user.

The slot is of relatively narrow width, i.e. is sufficiently narrow to prevent contact between the cutting edge of the blade and the fingers of a user, but of a sufficient width to accept the marginal edge portion of a package while maintaining the contents of the package safely spaced from the cutting edge.

BRIEF DESCRIPTION OF THE DRAWINGS

The invention will further be described, by way of example only, with reference to the accompanying drawings, wherein.

DESCRIPTION OF THE PREFERRED EMBODIMENT

Figure 3:
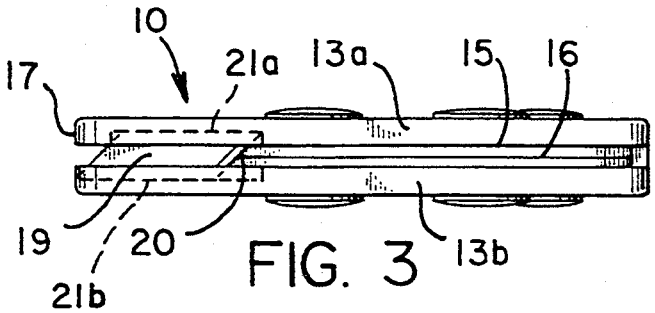
FIG. 3 is an enlarged plan view of the head portion of the cutter.
Figure 2:
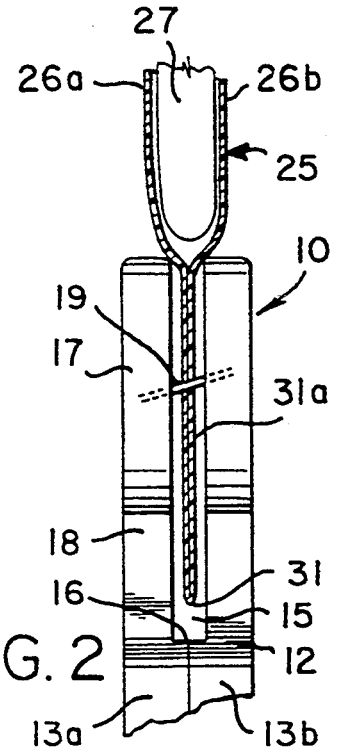
FIG. 2 is an enlarged fragmentary elevation of the upper portion of the cutter taken from the left hand side in FIG. 1.
Figure 1:
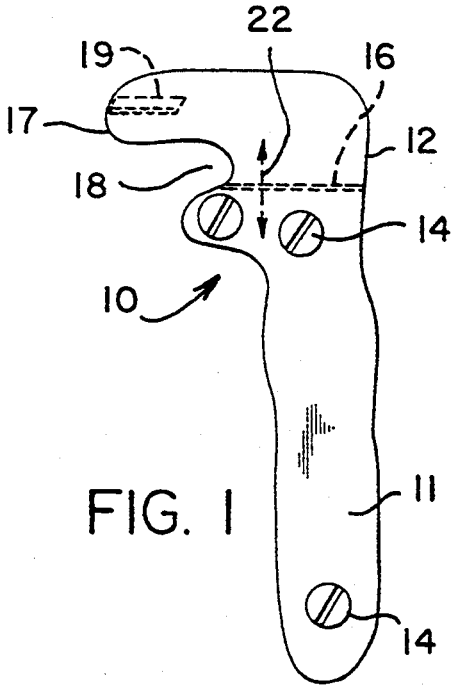
FIG. 1 is an elevational view of the cutter.

As seen in FIG. 1, the cutter implement 10 has an elongate handle 11 at the distal end of which is a carrier 12. The cutter implement 10 comprises two confronting section 13*a*, 13*b* of identical outline as shown in FIG. 1 and fastened together by any suitable means, such as screws 14. In the region of the carrier 12 the sections 13*a*, 13*b* are recessed to define therebetween a narrow channel 15 opening from the distal end and having a base 16 that extends generally at right angles to the length of the handle 11, the channel 15 extending completely across the cutter implement from front-to-rear.

The carrier 12 of the cutter has a rearwardly projecting rounded nose 17 beneath which is defined a concave recess 18 into which the channel 15 opens. Within the nose 17 and spanning the opposed sides of the channel is a steel blade 19 having at the forward end thereof a cutting edge 20, the blade being generally aligned longitudinally with the channel 15 and the cutting edge being obliquely angled as shown. Alternatively, the cutting edge of the blade could have a V-shaped configuration as illustrated at 20*a* in the blade 19*a* of FIG. 4. The blade 19 is received at its ends in confronting grooves 21*a*, 21*b* in the sections 13*a*, 13*b* respectively of the implement. Other convenient ways of securing the blade would be by molding or by the use of suitable adhesives.

To facilitate use of the cutting implement with bags having marginal regions of various widths, it is convenient to arrange for the base 16 of the channel to be adjustable in the direction indicated by the arrow 22 in FIG. 1.

The use of the cutter implement will now be described, particularly in relation to FIG. 4 of the drawings, as used for opening a package that is generally illustrated at 25. The package shown comprises a rectangular pouch formed between confronting sheets 26*a*, 26*b* of a thin flexible plastic material such as polyethylene, the sheets being sealed together at their edges to enclose the bag contents 27, e.g. a flat folded bag. Only a portion of the package 25, in the vicinity of one corner 28 formed between adjacent edges 30 and 31, is shown.

Figure 4:
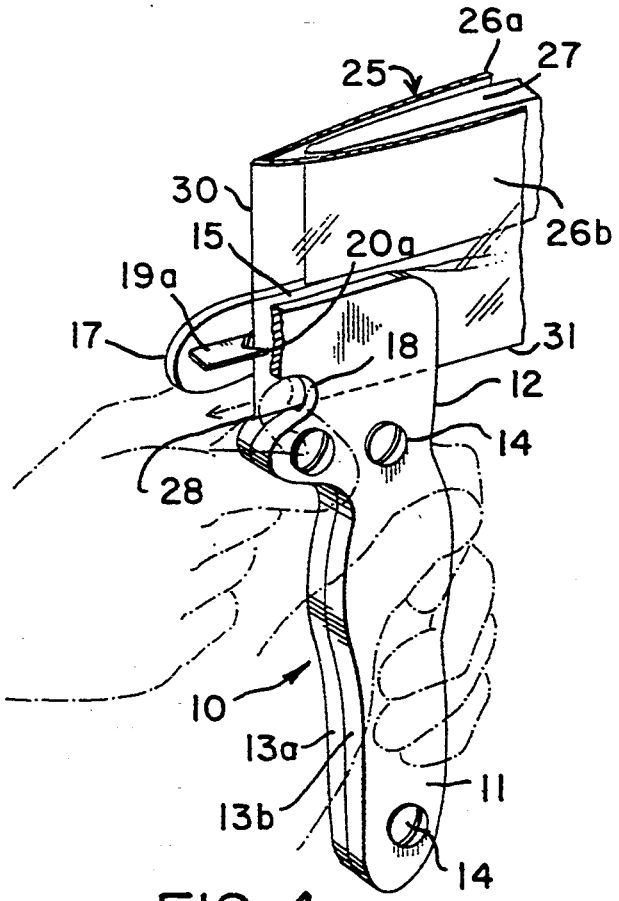
FIG. 4 is a perspective view partially fragmented, showing the cutter in use.

The package 27 is moved as seen in FIG. 4 from right-to-left, to introduce the marginal region 31*a* along the edge 31 into the channel 15. The channel 15 is of a width sufficient to receive the confronting sheets 26*a*, 26*b*, but narrow enough to prevent the package content 27 from entering the channel. With the lower edge 31 of the package in contact with the bottom 16 of the channel, the package 25 is moved until the leading edge 30 is adjacent the cutting edge 20 of the blade 19.

From this position, the package could be pushed further to the left as seen in FIG. 4, but such pushing action would not produce a reliable cutting effect of the blade 19 on the marginal portion 31*a* since because of the inherent flexibility of the plastic material of the sheets 26*a*, 26*b*, the marginal region 31*a* would be prone to buckle and bunch ahead of the blade 19 without any reliable cutting action taking place. It is for this reason that the recess 18 is provided in the cutter implement forwardly of and below the cutting edge 20. This recess enables the corner portion 28 of the package 25 to be gripped (see FIG. 4) between the thumb and forefinger of one hand of the user whereupon when the cutter implement 10 is moved (to the right as seen in FIG. 4) by the users other hand, the marginal area 31*a* of the package being therefore held in a taut, or tensioned condition so as to be easily severed by the blade 19.

Thus the implement can be drawn in a single stroke along the entire length of the edge 31 severing the marginal portion 31*a* completely and thus providing access to the package interior. As noted, during this movement, the package content 27 will be held reliably out of the channel 15 and therefore is in no danger of being damaged by the blade. Similarly, because of the recessed position of the blade and the narrowness of the channel 15, there is no likelihood of the fingers of the user coming into contact with the blade, so that this possible source of injury is avoided.

What I claim is:

1. A cutter useful for opening a package that has contents enclosed within generally flat overlapping walls of thin flexible material, such package having extending along a first edge thereof at least one marginal region wherein said walls are in contact, said first edge terminating at a corner that is adjacent a second edge of the Package, said cutter, comprising a carrier that defines therein an elongate narrow channel having depth-limiting base means; a blade supported and shielded in the region of one end of the channel of ,said carrier and oriented to face in a forwards direction towards the second, opposite end of said channel at a predetermined spacing from the channel base means;

said carrier defining a recess providing manual access to said channel on opposite sides thereof at a location that is forward of said blade and that is within said predetermined spacing between the blade and the channel base means;

the arrangement being such that when said package corner is introduced into the channel in a direction parallel to said first edge until the second package edge abuts the blade, the package corner is located in said recess and can be grasped by the user to retain the package in proper alignment and supported so that the package wall material in said marginal region is tensioned to facilitate cutting thereof by the blade as the latter is moved relative to said package away from said corner along said first edge.

2. A cutter as claimed in claim 1 wherein said channel, at least in the vicinity of said cutting edge, has a width that is sufficiently narrow as to prevent contact between the cutting edge and the fingers of a user.

3. A cutter as claimed in claim 1 wherein said carrier includes a handle to facilitate gripping and manipulation of the cutter by a user.

4. A cutter as claimed in claim 3 wherein said handle is of elongate form extending in the direction of the depth of the channel and sized for engagement in the fingers and palm of one hand of the user.

5. A cutter as claimed in claim 1 wherein said channel has the form of a slot of uniform narrow width, said width being sufficient to allow entry of said marginal region of the package extending along said first edge while preventing entry of any portion of the package contents, thereby preserving such contents from accidental contact with and damaged by said cutting edge.

6. A cutter as claimed in claim 1 wherein said cutting edge of the blade is angled with respect to a plane normal to the length of said channel, to improve the cutting action of said blade.

7. A cutter as claimed in claim 1 wherein said blade is positioned in a nose section of said channel at one end thereof, the carrier being recessed beneath this nose section to facilitate grasping of the corner of the package when the latter is inserted into said cutter.

8. A cutter as claimed in claim 1 wherein said carrier includes an integral elongate handle and is formed in two confronting sections which are detachably interconnected and which define said channel therebetween.

9. A cutter as claimed in claim 8 wherein said blade is detachably supported between opposed sections of said carrier.

10. A cutter as claimed in claim 9 wherein said carrier is fabricated in a plastics material, and said blade is of steel.

* * * * *